US007442949B2

(12) United States Patent
Foster

(10) Patent No.: US 7,442,949 B2
(45) Date of Patent: Oct. 28, 2008

(54) PORTABLE NUCLEAR RADIOACTIVE FALLOUT SHELTER AND PRESERVATION OF POTABLE WATER STORAGE SYSTEM

(76) Inventor: Stanley Earl Foster, P.O. Box 2344, Titusville, FL (US) 32781-2344

( * ) Notice: Subject to any disclaimer, the term of this patent is extended or adjusted under 35 U.S.C. 154(b) by 318 days.

(21) Appl. No.: 11/491,812

(22) Filed: Jul. 24, 2006

(65) Prior Publication Data

US 2008/0016815 A1 Jan. 24, 2008

(51) Int. Cl.
*G21F 3/04* (2006.01)
*G21F 7/00* (2006.01)

(52) U.S. Cl. ..... 250/517.1; 52/2.22; 52/169.5; 52/169.6; 52/591.1; 220/23.83; 109/1 S

(58) Field of Classification Search ..... 250/517.1; 52/2.22, 169.5, 169.6, 591.1; 220/23.83; 109/1 S
See application file for complete search history.

(56) References Cited

U.S. PATENT DOCUMENTS 3,197,641 A * 7/1965 Larkin ..... 250/517.1
3,208,410 A * 9/1965 Hayes et al. ..... 109/1 S
3,680,498 A * 8/1972 Roos ..... 109/1 S
4,153,845 A * 5/1979 Fava ..... 250/517.1
4,400,623 A * 8/1983 Jacobson ..... 250/517.1
4,692,060 A * 9/1987 Jackson, III ..... 405/115
5,241,573 A * 8/1993 Thacker ..... 250/517.1
6,200,067 B1 * 3/2001 Pena ..... 405/115

* cited by examiner

*Primary Examiner*—Jack I Berman

(57) ABSTRACT

The Portable Nuclear Radioactive Fallout Protection Shelter & Preservation of Potable Water Storage System is comprised of self-supporting interlocking stackable radiation shielding watertight jugs having the dual purpose of being used to rapidly assemble fallout shelters and to store drinking water. The jugs are made of rigid neoprene, plastics, or similar substances that when filled with water and properly assembled omits radioactive gamma and X-rays. Wooden or metal support beams may be required when ceiling supports are necessary. The jugs may be filled using a common garden hose and be emptied by pouring water out of the water spouts that are also an integral part of the self supporting interlocking mechanisms and be drained by pouring water from the spouts or using a siphon hose or water pump. The system implements the construction of walls, modules, and complete protective shelters inside or outside of existing buildings.

14 Claims, 16 Drawing Sheets

Radiation Barrier Jug

Showing interlocking mechanism

- right surface: protruding handle
- top surface: two male studs one of which is the capped water port
- front surface: two male studs

Figure #1
Radiation Barrier Jug
Showing interlocking mechanism
- right surface: protruding handle
- top surface: two male studs one of which is the capped water port
- front surface: two male studs
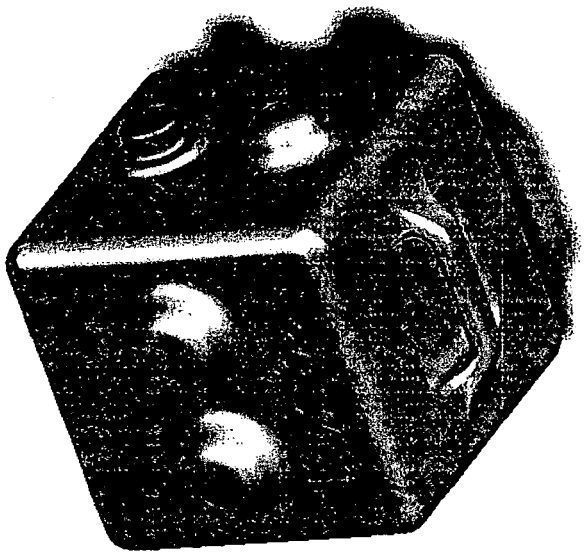

Figure #2
Radiation Barrier Jug
Showing interlocking mechanism
- Front / right surface: two female slots
- bottom surface : protruding handle
- front / left surface: two female slots
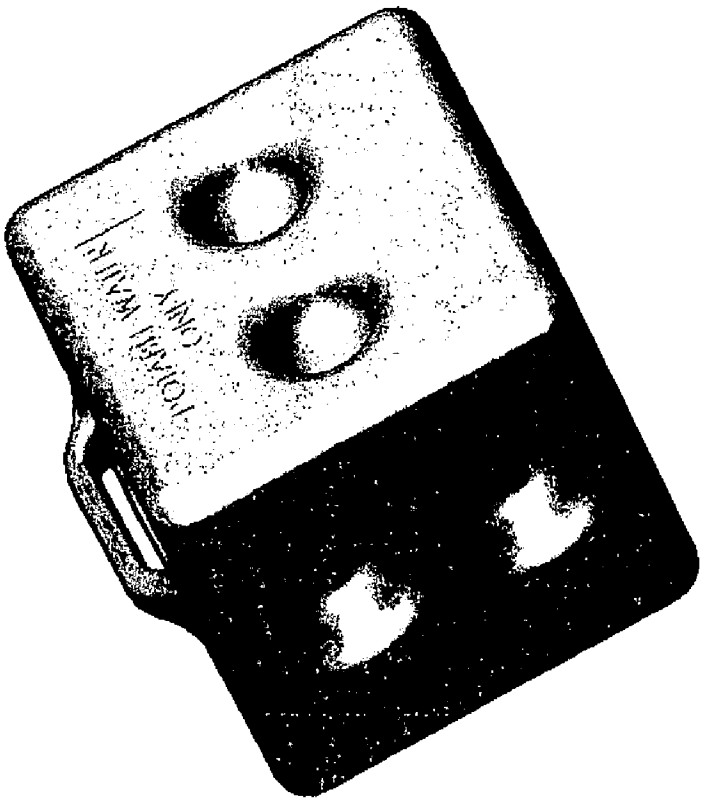

Figure #3
Radiation Barrier Jug
Showing interlocking mechanism
- top surface: interlocking slot for protruding handle
- right surface : two male studs one of which is the capped water port
- front surface: two male studs
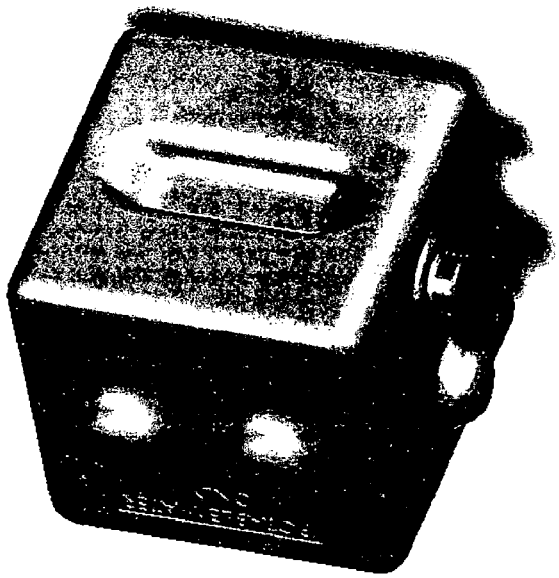

Figure #4
Radiation Barrier Jug
Showing interlocking mechanism
- top / left surface: two female slots
- top / right surface : interlocking slot for protruding handle
- bottom surface: two female slots
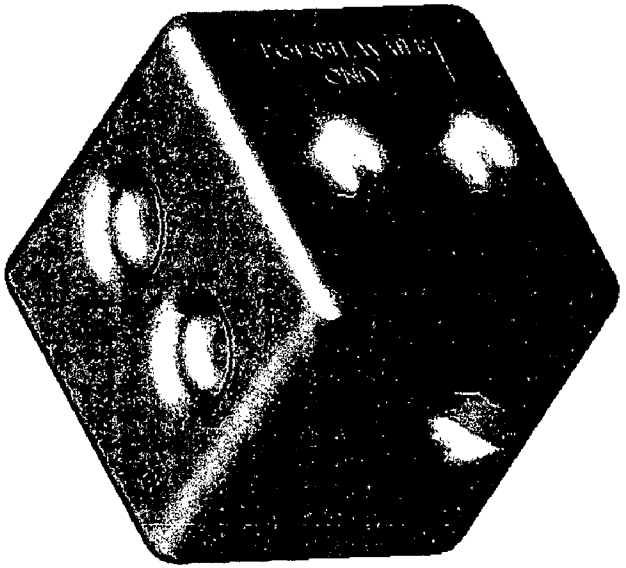

Figure #5
Radiation Barrier Jugs
With three jugs cut in half to better display overlapping assembly and interlocking mechanism that creates the solid wall without spaces as claimed.
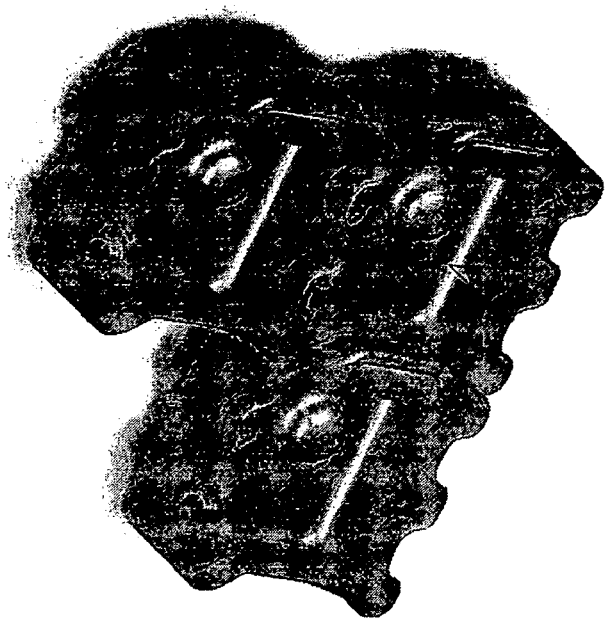

Figure #6
Radiation Barrier Jugs
Bottom view of three jugs cut in half to better display overlapping assembly and interlocking mechanism that creates the solid wall without spaces as claimed.
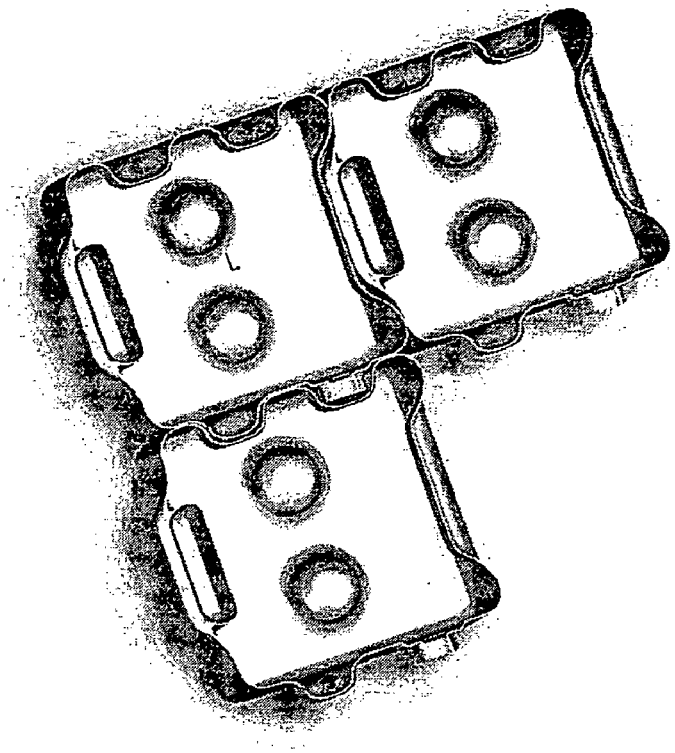

FIG #7A

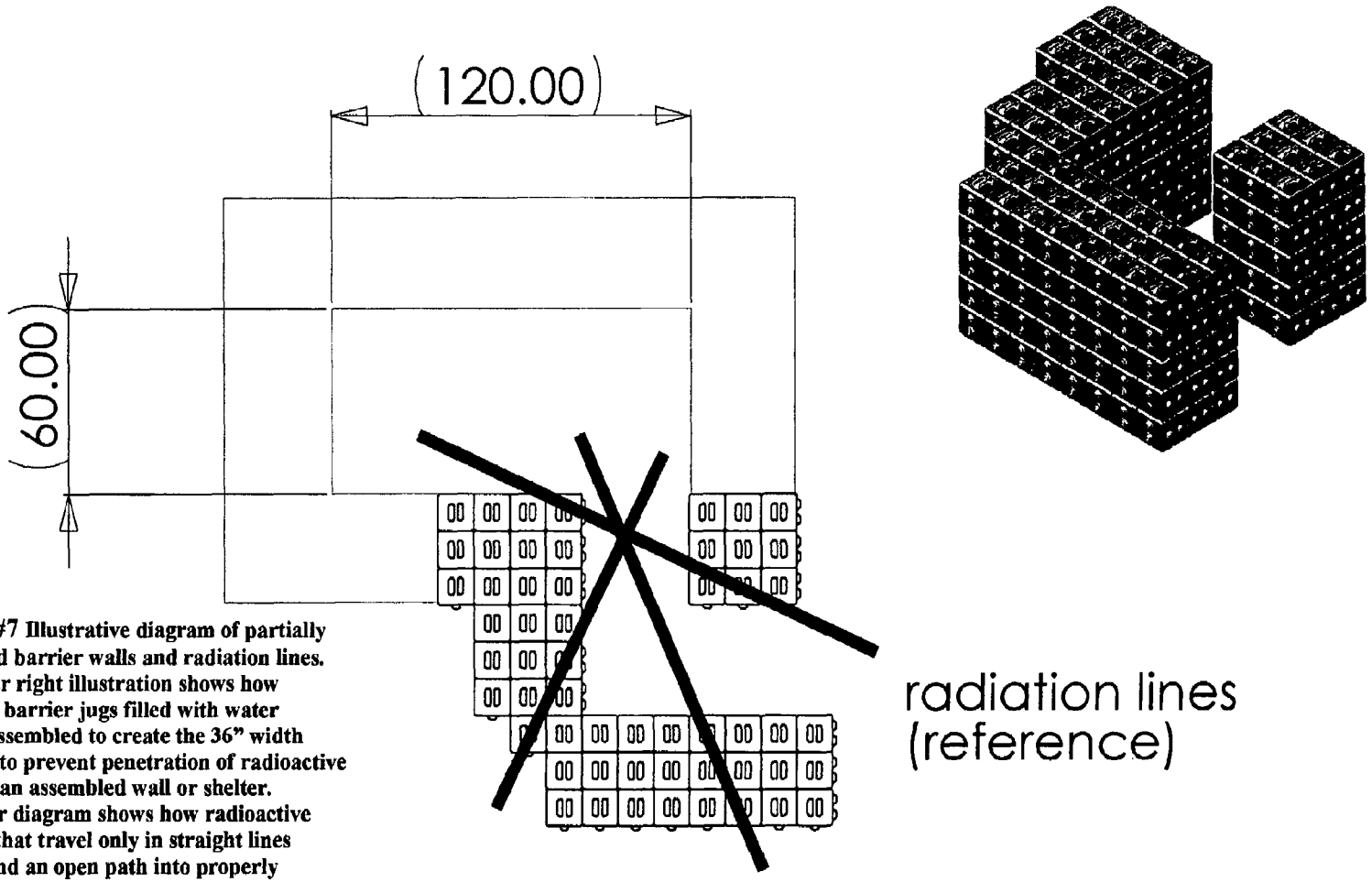

Figure #7 Illustrative diagram of partially assembled barrier walls and radiation lines. The upper right illustration shows how radiation barrier jugs filled with water may be assembled to create the 36" width required to prevent penetration of radioactive rays into an assembled wall or shelter. The lower diagram shows how radioactive rays ays that travel only in straight lines cannot find an open path into properly constructed shelters that employ "L" shaped openings called maze entrances.

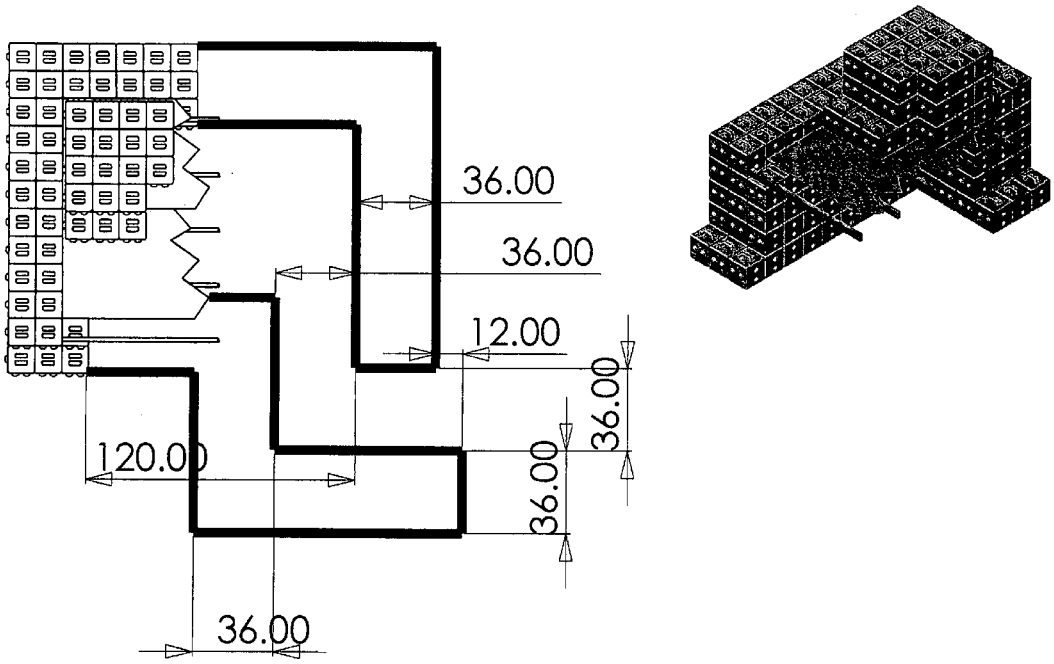
FIG #7B

Figure #8
Illustrative diagram of a partially assembled radiation barrier shelter including ceiling comprised of water filled jugs.
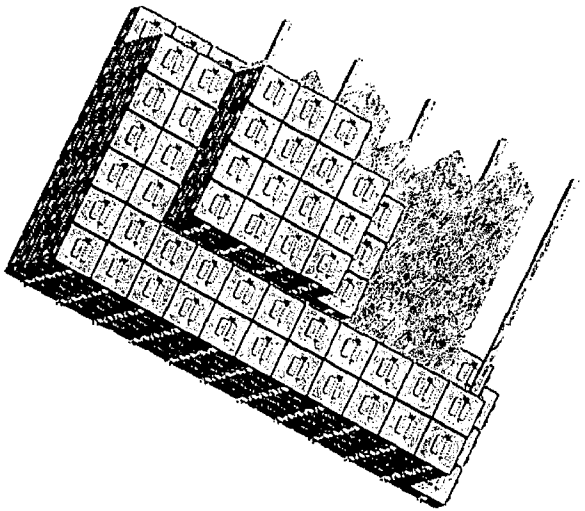

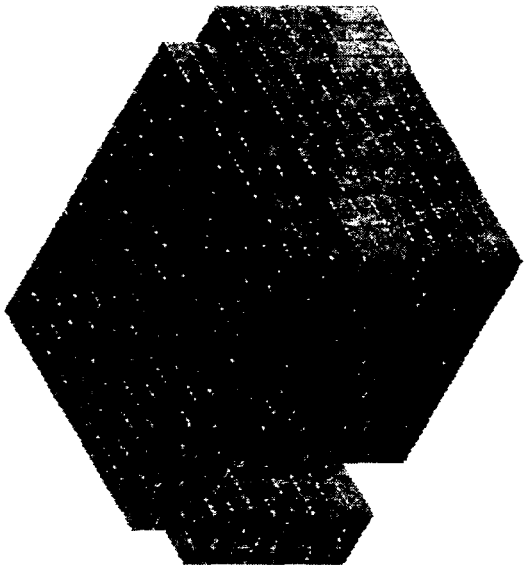
FIG #9 (NINE)
STANDARD FREE STANDING STRUCTURE
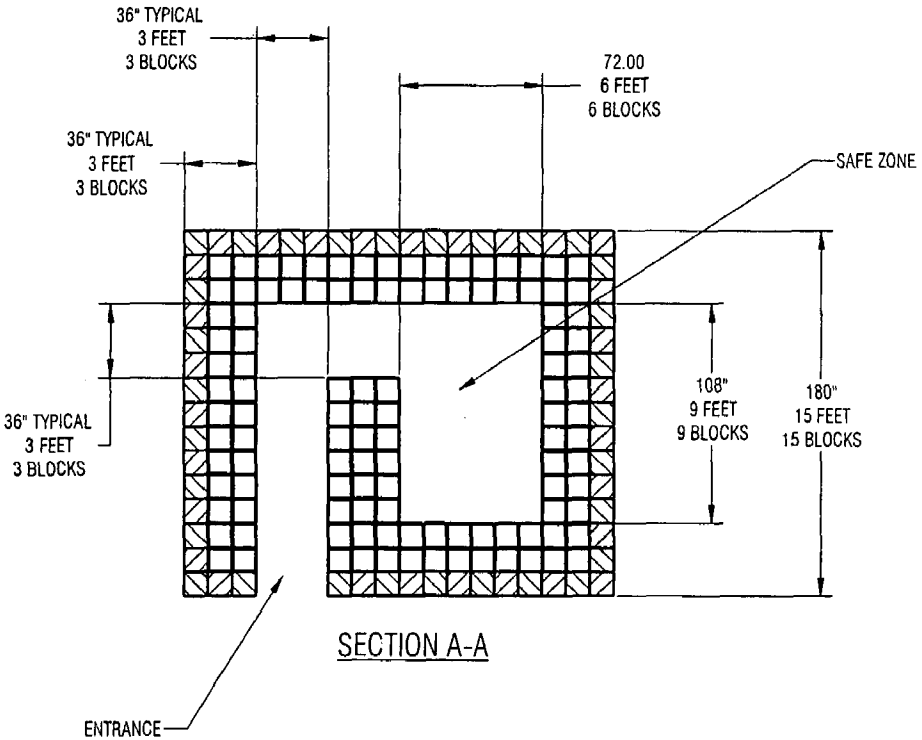
SECTION A-A
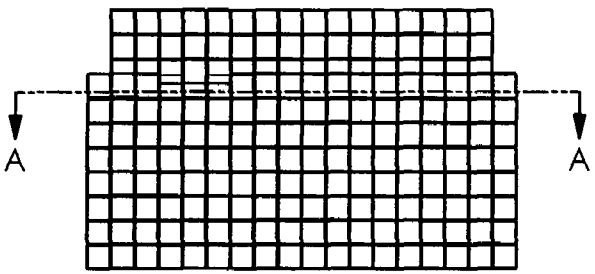

FIG #10
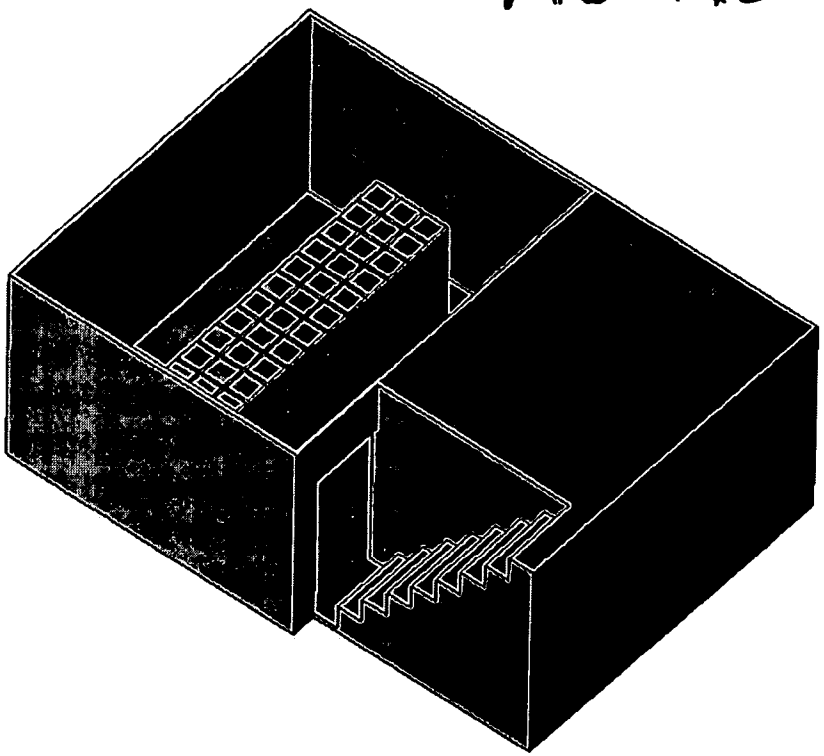
BUNKER OR BASEMENT STRUCTURE
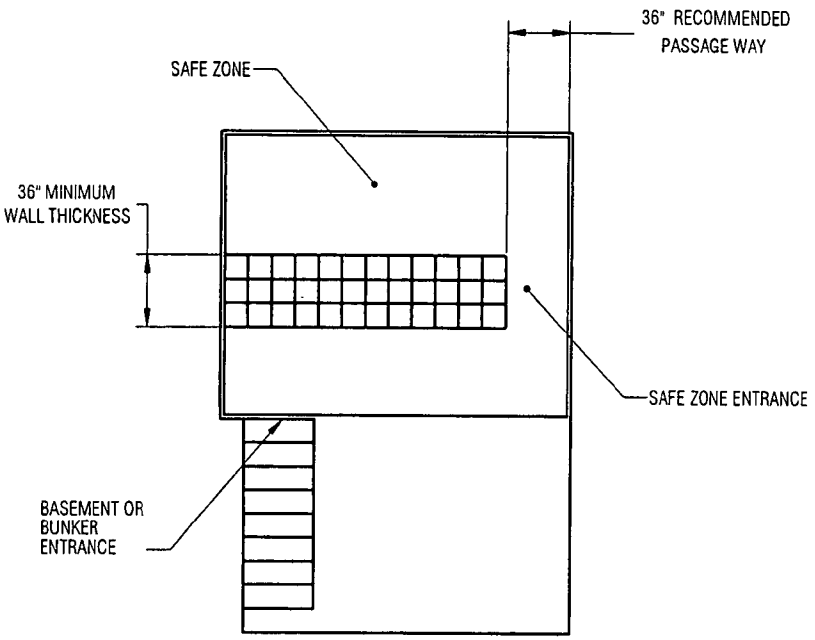

FIG #11

NOTES: UNLESS OTHERWISE SPECIFIED

1. MATERIAL: HIGH DENSITY POLYETHYLENE, (HDPE)
2. COLOR: WHITE
3. TOOL DESIGN REVIEW REQUIRED BEFORE PROCEEDING WITH CONSTRUCTION.
4. DIMENSIONS ON DRAWING ARE FOR REFERENCE ONLY BUILD FROM LATEST CAD MODEL SUPPLIED EXCEPT AS NOTED.

IMPORTANT

5. THREADS ARE TO BE BUILT FROM DRAWING DATA CAD MODEL IS ONLY A THEORETICAL REPRESENTATION. AND MAY NOT REFLECT ACTUAL THREADS.

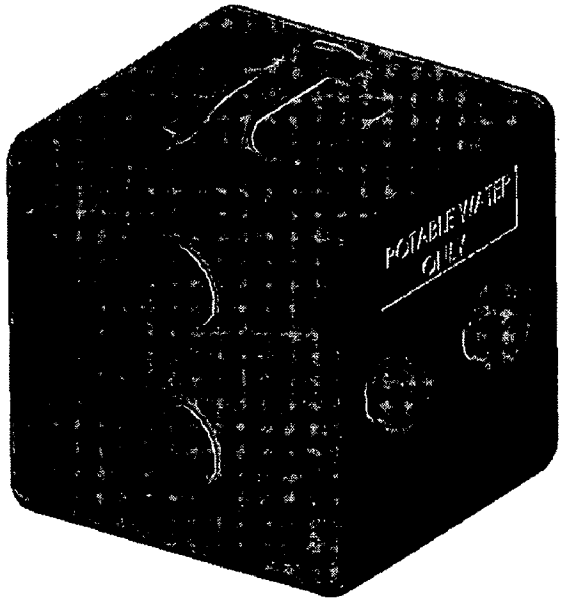

ISOMETRIC VIEWS
FOR VISUAL AID ONLY

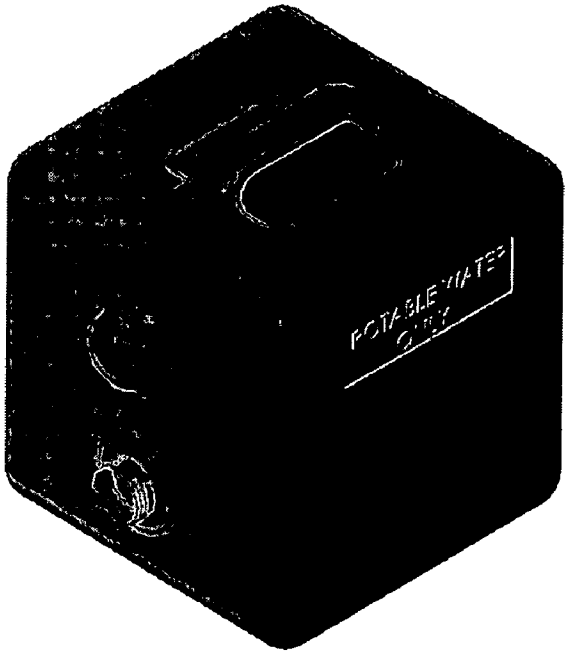

FIG # 12
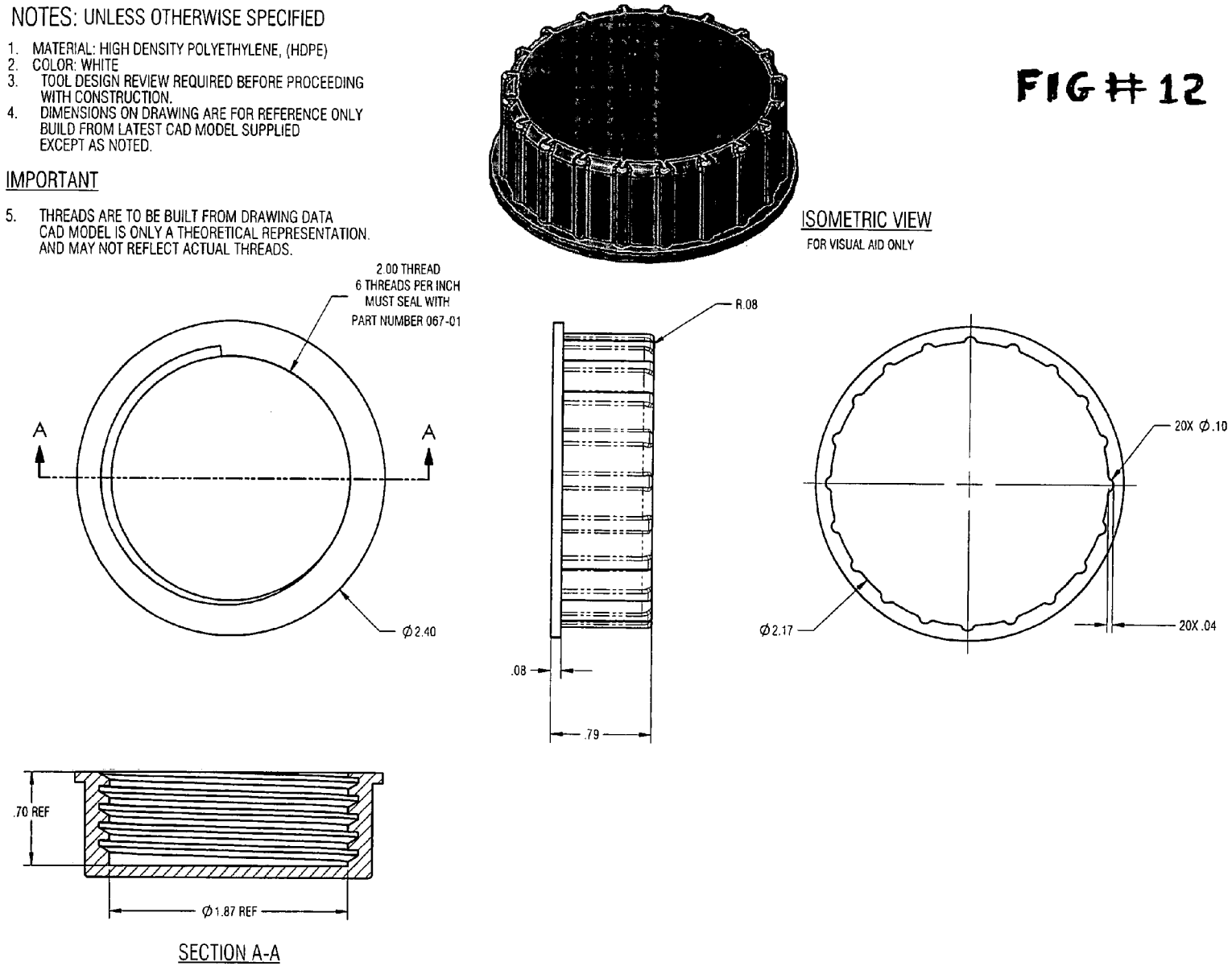

FIG # 13

NOTES: UNLESS OTHERWISE SPECIFIED

1. STANDARD WALL THICKNESSS RQUIRED FOR EFFECTIVENESS IS 3 BLOCKS THICK
2. STANDARD CEILING THICKNESS REQUIRED FOR EFFECTIVENESS IS 3 BLOCKS THICK
3. CEILING REQUIREMENTS ARE 4 X 8 X 3/4" THICK PLYWOOD AS REQUIRED
4. CEILING JOISTS REQUIRE 2 X 6 CONSTRUCTION.
5. SYSTEM IS COMPRISED OF CONTAINER 067-01 AND CONTAINER CAP 068-01

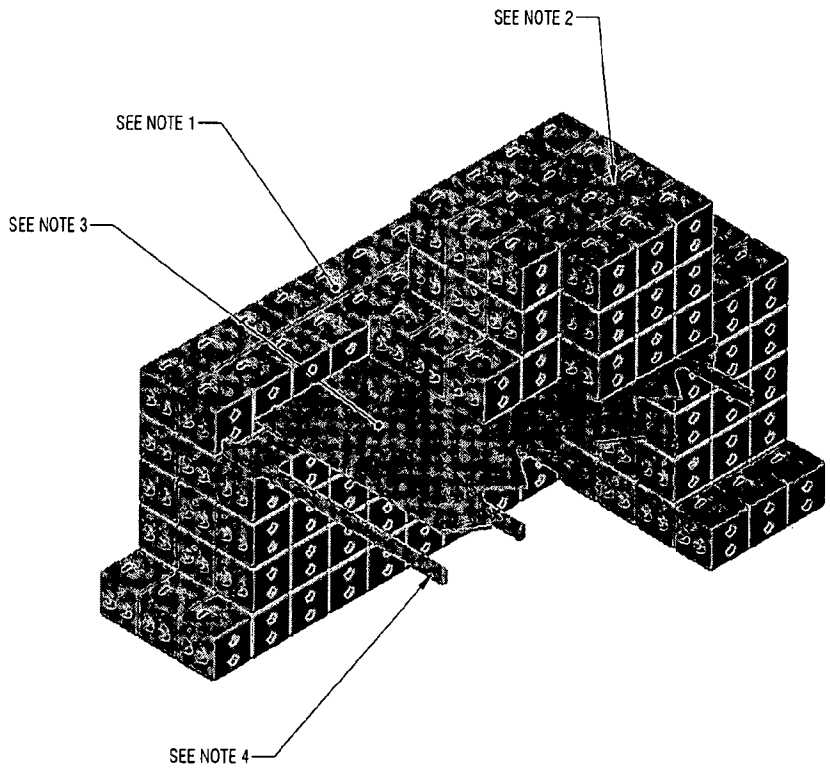

SEE SHEET 2 FOR STANDARD FREE STANDING STRUCTURE
SEE SHEET 3 FOR STANDARD BUNKER OR BASEMENT STRCTURE

FIG # 14
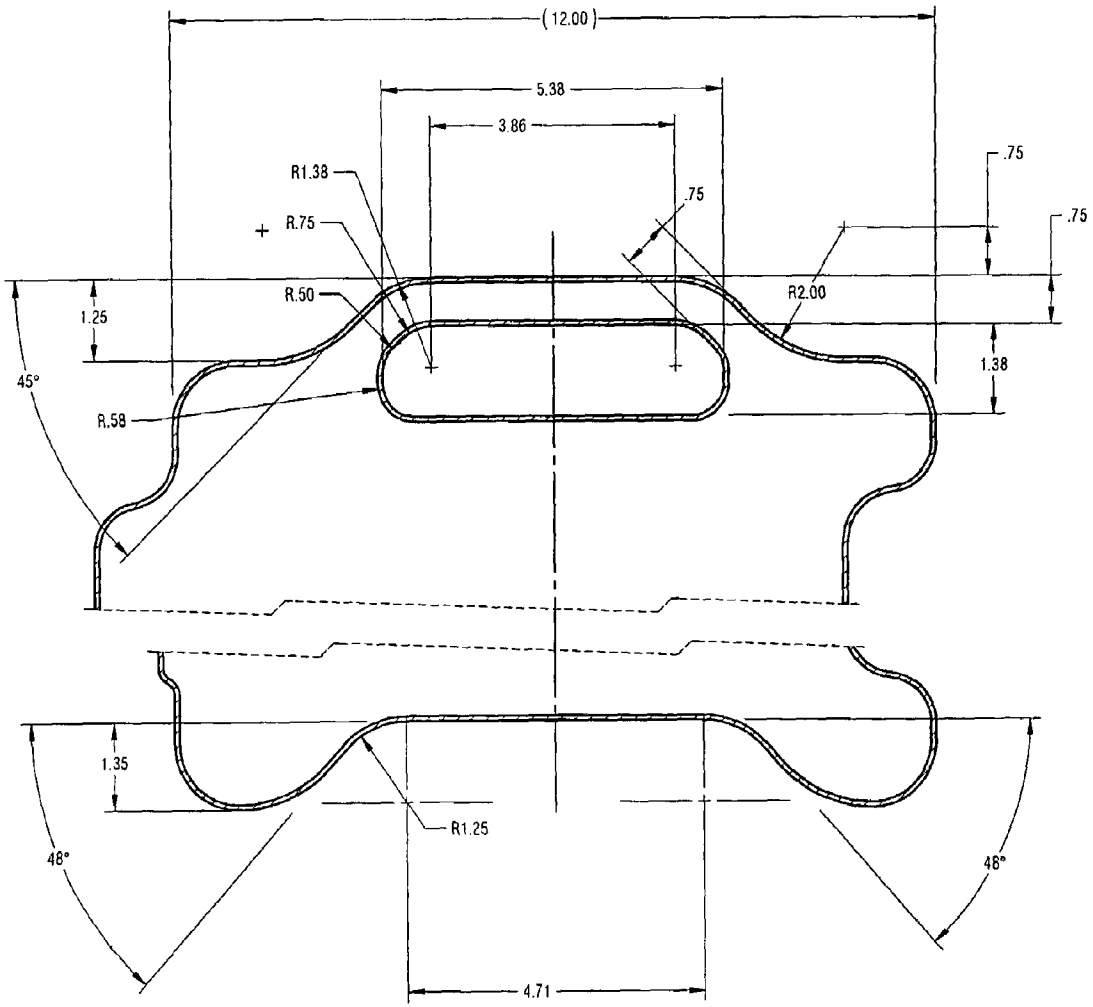
SECTION B-B
HANDLE AND HANDLE RECIEVER DETAIL

FIG #15
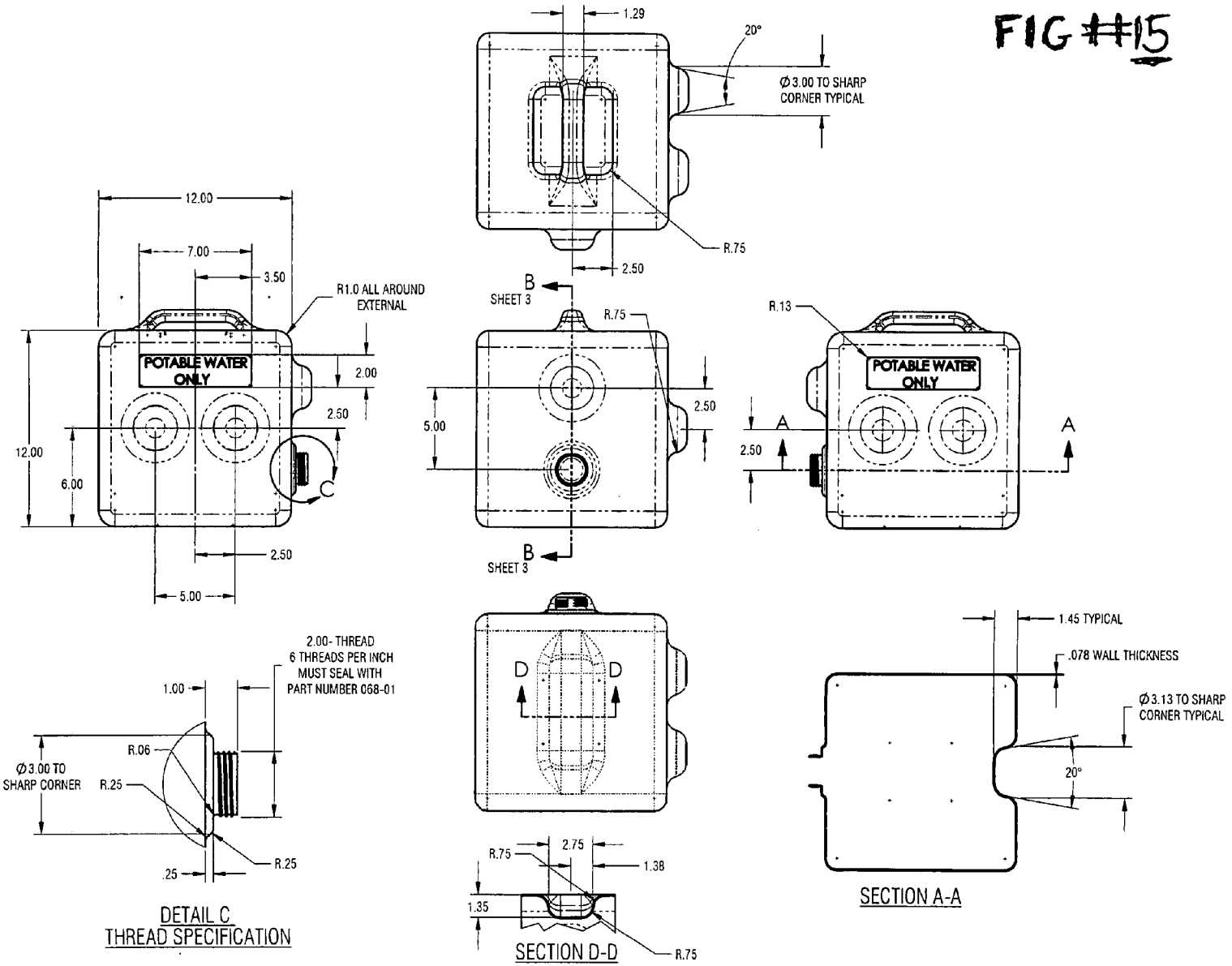

PORTABLE NUCLEAR RADIOACTIVE FALLOUT SHELTER AND PRESERVATION OF POTABLE WATER STORAGE SYSTEM

The Portable Nuclear Radioactive Fallout Protection Shelter & Preservation of Potable Water Storage System predominately comprised of self-supporting interlocking stackable radiation shielding watertight jugs specifically designed for the dual purpose of being used to rapidly assemble fallout shelters and storage of potable drinking water by unskilled labor without tools, or with a minimum of household tools in shelters requiring a roof assembly.

The self-supporting interlocking system provides for air vent openings that will allow air flow in and out of the shelter while omitting radioactive waves i.e. gamma and X-rays. Shelters may be built either individually or in connected modules depending upon the sizes, shapes, and dimensions necessary in the formation of specific shelter applications for temporary or substantially long term usage.

The jugs may be filled with water using a common garden hose either before assembly or a layer at a time during assembly of a wide range of sizes, shapes, and dimensions of radiation barrier walls, entranceways, ceilings, and complete shelters.

Since the jugs will be made of pre-formed heavy duty rigid material and shall be of a size and weight that when empty they may be easily handled by nearly anyone who is not significantly disabled and when filled with water may be easily handled by any physically able person capable of lifting and moving weights up to 62.5 pounds. The jugs may be emptied by pouring water out of the water spouts that are also an integral part of the self supporting interlocking mechanisms or be drained using a siphon hose or water pump.

The system implements the construction of not only complete nuclear radiation shelters but also barrier walls where existing building construction walls provide protection on one or more sides and/or ceiling but not at one or more other sides where protection of existing constructed walls do not provide sufficient protection. Thus, the system includes walls, ceilings, and complete shelters of varying sizes and dimensions to shield varying numbers of people depending upon the interior dimensions of the shelter from nuclear radiation i.e. gamma and X-rays and to preserve and store potable water for usage during sheltering and after radioactive activity diminishes.

BACKGROUND

1. Field of Invention

The present invention relates to the construction of both temporary and relatively permanent barriers, walls, and shelters that will provide protection from nuclear radioactive fallout i.e. gamma and X-rays and storage and preservation of uncontaminated potable water using the means and methods of the system set forth herein. The system employs the use of specially engineered self-supporting, interlocking, stackable jugs as described herein all of which in any given barrier or shelter may be filled with potable water, however if the combined content volume of all the jugs does not need to be potable water, as may be the case for permanent barriers, walls, or shelters, a portion of the less accessible jugs at the bottom of said barrier, wall, or shelter, may be filled with any available fluid and be so labeled. The primary motivation and purpose for this invention is to provide a means of fast and easy construction of barriers and/or complete shelters to protect people from radioactivity emanating from any source, but especially from "dirty bombs" and other nuclear explosions including but not limited to nuclear accidents, and provide survivors with a readily available supply of uncontaminated potable water. Time is of essence for the quickest possible patent issue, manufacture, and marketing of this invention that is certain to be welcomed by and utilized in private, public, governmental, and military sectors; more specifically in dwellings and facilities including but not limited to surrounding and inside industrial nuclear facilities, power plants, electrical generator and circuit rooms, financial facilities, military installations, government buildings, schools, hospitals, civil service facilities, police stations, fire stations, emergency response facilities and command posts.

2. Description of Prior Art

The prior art thought to be the closest in concept to the "Portable Radiation Protection Shelter & Water Storage System" is disclosed in U.S. Pat. No. 6,200,067 to Pena; Martin Rangel (1999) in which water bags are the main component that require weight baring struts and sundry extraneous fastening devices essential to support, containment, adhesiveness, and shape of assembled structures. A second prior art patent that preceded the above referenced prior art patent that primarily utilizes sand bags is U.S. Pat. No. 4,692,060 to Jackson (1987).

BRIEF SUMMARY OF THE INVENTION

The apparent novelty of the present invention, the "Portable Nuclear Radioactive Fallout Protection Shelter & Preservation of Potable Water Storage System", is its innovative self-supporting, interlocking jugs that comprise the system providing a uniquely applied and better suited means for the construction of nuclear radiation barriers and shelters than more generalized barriers comprised of water bags requiring supporting mechanisms and those comprised of predominately sand bags. The present invention relative to the said application encompasses relatively tremendous improvement in suitability, utility, design, and strength over existing art.

The existing art is comprised of weaker more flimsy water bags that require additional support of weight baring struts and sundry extraneous fastening devices and barrier systems that use cumbersome sand bags. The jugs may be manufactured using any materials commonly used in, or may be adapted to blow molding manufacturing including compositions that facilitate greater weight baring capabilities including but not limited to being bullet proof.

The system may be applied to applications of many shapes and sizes be relatively quickly and easily assembled without tools by unskilled labor or with a minimum of ordinary household tools in situations requiring a roof as described in the claims.

The Invention-objects and advantages of the "Portable Nuclear Radioactive Fallout Protection Shelter & Preservation of Potable Water Storage System" over prior art was clearly noted within and throughout the claims and the "Description of Prior Art" above. Furthermore, regardless of all inclusive, futuristic, presumptuous and unspecified possible applications uses and modifications that may or may not be made by the prior art herein stated, the "Portable Nuclear Radioactive Fallout Protection Shelter & Preservation of Potable Water Storage System clearly stands unique and paramount in addressing the applications and functions for which it has been designed as stated and claimed herein.

BRIEF DESCRIPTION OF THE DRAWINGS

Although there are only six sides to a cube, in order to display the means of all the interlocking mechanisms of the radiation jugs, three sides of the jugs and cutaways are repeatedly shown to adequately present the surface to surface tightness and assembly of the interlocking mechanisms. Drawings have been presented in the best form possible to comply with the standard USPTO format, however because most were created using standard computer programs and formatted as shown according to manufacturing criteria, it is respectfully requested that obvious variances be allowed.

FIG. #1 Radiation Barrier Jug showing three sides of the interlocking mechanism that couples jugs together in assembly of radiation barrier walls and shelters. Note the right surface shows protruding handle, the top surface shows two male studs, one of which is the caped water port, and the front surface shows two male studs.

FIG. #2 Radiation Barrier Jug showing three sides of the interlocking mechanism that couples jugs together in assembly of radiation barrier walls and shelters. Note the front/right surface shows two female slots, the bottom surface shows protruding handle, and the front/left surface shows two female slots.

FIG. #3 Radiation Barrier Jug showing three sides of the interlocking mechanism that couples jugs together in assembly of radiation barrier walls and shelters. Note the top surface shows interlocking slot for protruding handle, the right surface shows two male studs with one showing the capped water port, and the front surface shows two male studs.

FIG. #4 Radiation Barrier Jug showing three sides of the interlocking mechanism that couples jugs together in assembly of radiation barrier walls and shelters. Note the top/left surface shows two female slots, the top/right surface shows the interlocking slot for protruding handle, and the bottom surface shows two female slots.

FIG. #5 Three Radiation Barrier Jugs cut in half to show the overlapping assembly and interlocking mechanism that creates the solid wall without spaces as claimed.

FIG. #6 Three Radiation Barrier Jugs cut in half but shown from the top view showing the overlapping assembly and interlocking mechanism that creates the solid wall without spaces as claimed.

FIG. #7A (page 1 of 2 pages) There are two illustrations: One shows the assembled shelter barrier walls with emphasis on the entrance of a shelter showing radiation lines depicting how radiation rays i.e. gamma or X-rays can travel only in straight lines from their source and because of the layout of the barrier walls of a shelter, cannot enter into the shelter through the openings employing "L" shaped configuration of shelter openings referred to as "maze entrances". The second illustration shows how the entrance way "maze" would look with the jugs interlocked three abreast and stacked.

FIG. #7B (page 2 of 2 pages) Is a further development showing measurements or a maze entrance with the addition of a partial roof and a second illustration showing a partial roof to illustrate how the roof comprised of jugs piled three high might be formed to provide the necessary protection from above. Note the supporting mechanism to support the jugs can be attained by using a combination of beams and plywood.

FIG. #8 The illustration shows a partially constructed room from a top view and different angle than illustrated in FIG. #7.

FIG. #9 The drawings on the left show the construction layout of the pictured completed shelter to the right of the drawings.

FIG. #10 The drawing on the left shows the construction layout of a roofless basement shelter on the right. The means of formation of the pictured bunker or basement shelter could be applicable with various modifications to several existing building construction layouts in which the materials used, and the thickness of walls and ceiling would mandate variations in the construction of the bunker or basement shelter.

FIG. #11 Is a specification sheet relative to individual radiation barrier jugs entitled "WATER CONTAINER, SHELTER".

Note: The reason that the specification sheets #12, #13, #14, and #15 have been included is to show that the invention is well on its way to being manufactured; the specifications are essential to prospective manufacturers in the production of the radiation barrier jugs.

FIG. #12 Is a specification sheet relative to the waterproof fill port and its cap entitled "CONTAINER CAP".

FIG. #13 Is a specification sheet relative to the standard construction or assembly of the radiation barrier jugs entitled "STANDARD STRUCTURE CONSTRUCTION".

FIG. #14 Is a specification sheet relative to the radiation barrier jug handle and "receiver" or "interlocking slot for protruding handle" entitled "HANDLE AND HANDLE RECEIVER DETAIL".

FIG. #15 Jug specifications sheet: Shows eight diagrams of technical specifications for the manufacture of the radiation barrier jugs that will be presented to prospective manufacturers along with any other specifications required.

What is claimed is:

1. A portable, versatile, self supporting and weight bearing means and system for construction of Portable Nuclear Radioactive Fallout Protection Shelters & Preservation and storage of Potable Water Storage that effectively prevents nuclear radioactive rays (more technically referred to as electromagnetic radiation that includes X-rays and gamma rays) from penetrating through water filled jugs that comprise walls, barriers, and shelters, said means comprising:

a plurality of stand-alone interlocking jugs, each jug comprising a plurality of individual jug design features that includes a plurality of male studs and female slots that fit snugly into and around the recessed female slots and the male studs, respectively, of jugs of the same design when mated with one another, a protruding handle on one side that fits snugly into a recessed handle port of a jug of the same design when the jugs are mated with one another, and protruding watertight fill spouts that fit snugly into the recessed female slots of jugs of the same design when mated with one another.

2. The system of claim 1 wherein the system effectively prevents nuclear radioactive rays from penetrating through the walls, barriers, and shelters means that in addition to the jugs being filled with water, such is accomplished by the overlapping stacking and the interlocking means of assembling three containers abreast totaling a thickness totaling 36" that supplies the necessary thickness of water to be an effective barrier to shield occupants of the shelter from radioactive rays while also greatly enhancing the strength and weight bearing capacity of barrier walls and completed shelters.

3. The system of claim 1 wherein the jugs are placed to form walls inside an existing structures that is either above or partially under ground and has one, two, three, or four existing walls, with or without a ceiling, and is constructed of sundry kinds and thicknesses of materials that are known to act as a partial or sufficient barriers to radioactive rays depending upon their density and thickness.

4. The system of claim 1 wherein said jugs are manufactured using materials having properties selected from the group of being strong, resistant to natural and manmade environments, chemicals and substances, according to specifications necessary for specific installations and elements to which they will be subjected including being bullet proof.

5. The system relative to any of the preceding claims wherein the weights and measures of each individual "jug" are: volume—1 square foot, gallons of water=7.48, and weight, not including the weight of the jug,=62.30 pounds.

6. The system claimed in any of the preceding claims and further comprising support beams, and/or vertical support posts, of sufficient strength and plywood of sufficient thickness that will be placed across the top of barrier walls or shelters leaving enough space between any existing ceiling and the top of the beams and plywood for the placement of three layers of "jugs" or fewer layers if the existing ceiling offers protective radiation blockage that will make up the difference for less than three layers being applied.

7. The system of claim 6 relevant to beams and plywood used to support top jugs must be of sufficient length and strength to safely support the weight of the ceilings made of water-filled jugs; supporting vertical beams are also placed inside the shelter between the weight bearing walls depending upon the span between them.

8. The system of claim 7 further including guidelines to be supplied to builders relative to safe construction of shelters; all necessary instructions and safety warning labels to insure safe, easy and quick assembly by unskilled laborers including a statement stipulating that if the assembler doesn't understand the instructions supplied to enlist the aid of someone who does.

9. The system of claim 1, further comprising a plurality of additional jugs, in numbers mandated by the specifications of each barrier wall or shelter, arranged to form air vents using inner or outer wall "L" shaped arrangements that allow air to flow in and out as it follows the pathway of said "L" while not allowing radioactive rays from entering because radioactive rays i.e. gamma and X-ray travel only in straight lines from their source.

10. The system of claim 1, further comprising a plurality of additional jugs, in numbers mandated by the specifications of each barrier wall or shelter, arranged to form maze entrances, "L" shaped arrangements that allow easy entrance and exit of people into and from sheltered areas while not allowing radioactive rays from entering because radioactive rays i.e. gamma and X-ray travel only in straight lines from their source.

11. The system of claim 4, wherein the jugs are color coded or marked to indicate the material from which they are formed.

12. The system of claim 4, wherein the jugs are manufactured from new materials.

13. The system of claim 4, wherein the jugs are manufactured from recycled materials.

14. The system of claim 4, wherein the jugs are manufactured by blow molding.

* * * * *